US005217049A

United States Patent [19]

Forsyth

[11] Patent Number: 5,217,049

[45] Date of Patent: Jun. 8, 1993

[54] POWER REBAR TYPING TOOL

[75] Inventor: Eugene E. Forsyth, Austin, Ark.

[73] Assignee: Gateway Construction Company, Inc., Chicago, Ill.

[21] Appl. No.: 914,051

[22] Filed: Jul. 13, 1992

Related U.S. Application Data

[63] Continuation-in-part of Ser. No. 739,612, Aug. 2, 1991, abandoned.

[51] Int. Cl.[5] ..... B21F 9/02

[52] U.S. Cl. ..... 140/93.6; 140/57

[58] Field of Search ..... 140/57, 93.4, 93.6, 140/119

[56] References Cited

U.S. PATENT DOCUMENTS

| | | | |
|---|---|---|---|
| 3,026,915 | 3/1962 | Jones et al. | 140/119 |
| 3,169,559 | 2/1965 | Working | 140/119 |
| 3,211,187 | 10/1965 | Paule et al. | 140/119 |
| 3,323,558 | 6/1967 | Collins | 140/93.6 |
| 3,391,715 | 7/1968 | Thompson | 140/93.6 |
| 3,428,096 | 2/1969 | Krylov et al. | 140/93.6 |
| 3,587,668 | 6/1971 | Ward | 140/93.6 |
| 3,590,885 | 7/1971 | Ward | 140/93.6 |
| 3,593,759 | 7/1971 | Wooge | 140/93.6 |
| 3,633,633 | 1/1972 | Countryman | 140/93.6 |
| 3,880,204 | 4/1975 | Sarff et al. | 140/93 A |
| 4,117,872 | 10/1978 | Gott et al. | 140/57 |
| 4,141,389 | 2/1979 | Göttel | 140/93 A |
| 4,177,842 | 11/1979 | Dilley | 140/93.6 |
| 4,354,535 | 10/1982 | Powell et al. | 140/93 A |
| 4,362,192 | 12/1982 | Furlong et al. | 140/93.6 |
| 4,498,506 | 2/1985 | Moody et al. | 140/93.2 |
| 4,559,977 | 12/1985 | Dilley | 140/93.6 |
| 4,577,554 | 3/1986 | Brouse | 100/26 |
| 4,655,264 | 4/1987 | Dilley | 140/93.6 |
| 4,685,493 | 8/1987 | Yuguchi | 140/119 |
| 4,762,154 | 8/1988 | Cianciullo | 140/119 |
| 4,834,148 | 5/1989 | Muguruma et al. | 140/119 |
| 4,941,515 | 7/1990 | Vrenning | 140/119 |
| 4,947,902 | 8/1990 | Lehmann et al. | 140/119 |
| 4,953,598 | 9/1990 | McCavey | 140/57 |

*Primary Examiner*—Lowell A. Larson

*Attorney, Agent, or Firm*—Stephen D. Carver; Jeffrey S. Ward

[57] ABSTRACT

A portable, hand operated power tool for automatically tying intersecting rods, preferably rebar. An electric drive motor system selectively energizes a transmission disposed within a protective casing. A wire feed mechanism and a spindle barrel assembly which twists the wire are controlled by separate positive drive actuators. A jaw assembly projects outwardly from the casing to encircle the crossed rebar sections, and wire is fed around guide channels defined within the jaws. Wire is transported by the installer in a belt mounted reel. The actuators are controlled by retractable levers operated by electromagnets and normally engage suitable slots within the actuators to prevent them from transmitting rotary motion. When the levers are withdrawn, rotary motion will be transmitted to feed or twist wire. The rigid jaw assembly comprises a pair of spaced apart and fixed jaw members integral with a tubular base coaxially surrounding the rotatable spindle. A looping jaw, controlled by a solenoid, is pivoted to the lower fixed jaws. The jaw members and the looping jaw comprise internal guide grooves which are aligned in operation to direct wire in a circular path about the rebar. The spindle barrel assembly includes a pair of cooperating, and aligned shear disks through which wire passes for cutting. A spindle nose cone comprises an adjustable tension control cone, a pair of twist guides on opposite sides of the cone, and wire guide canals are defined in its face.

20 Claims, 7 Drawing Sheets

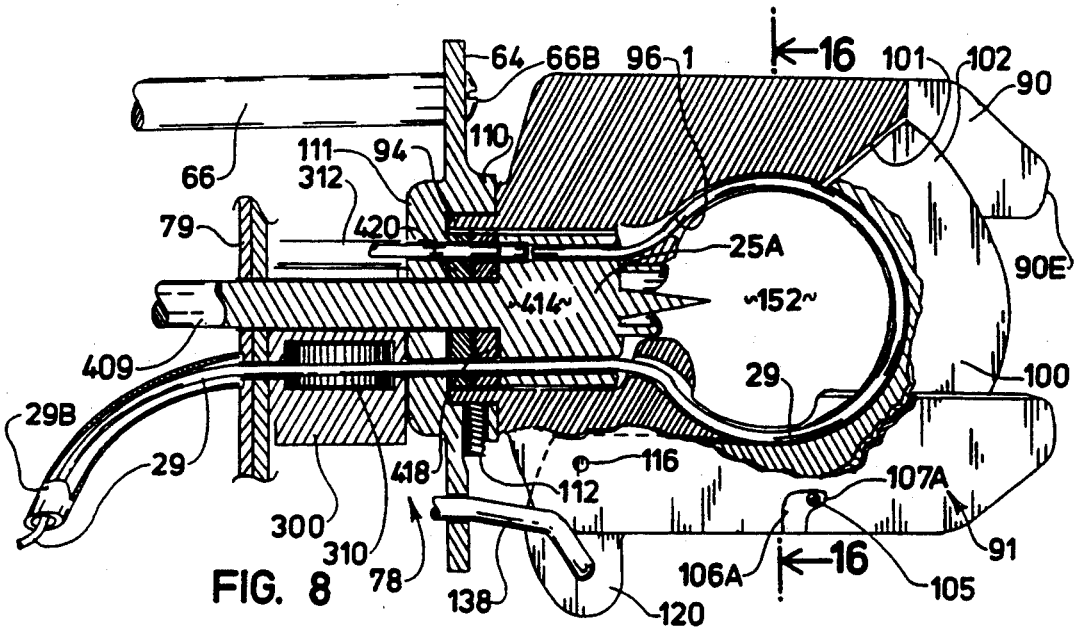
FIG. 8
FIG. 13
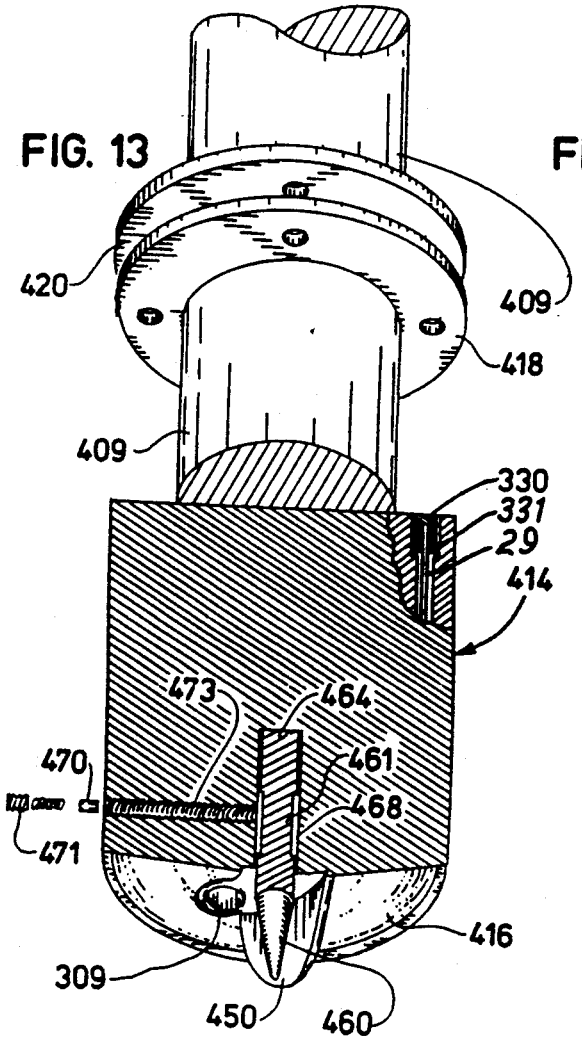
FIG. 14
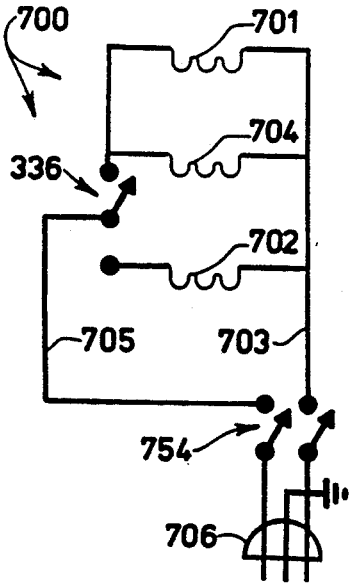

FIG. 11
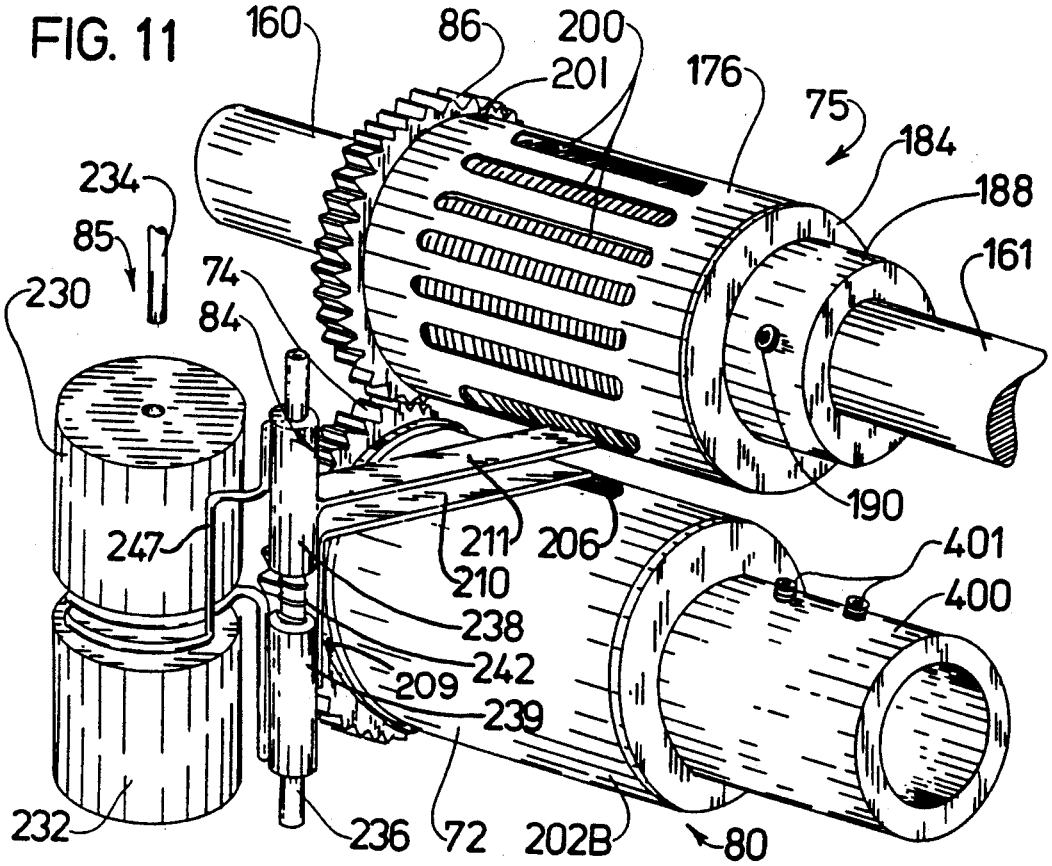
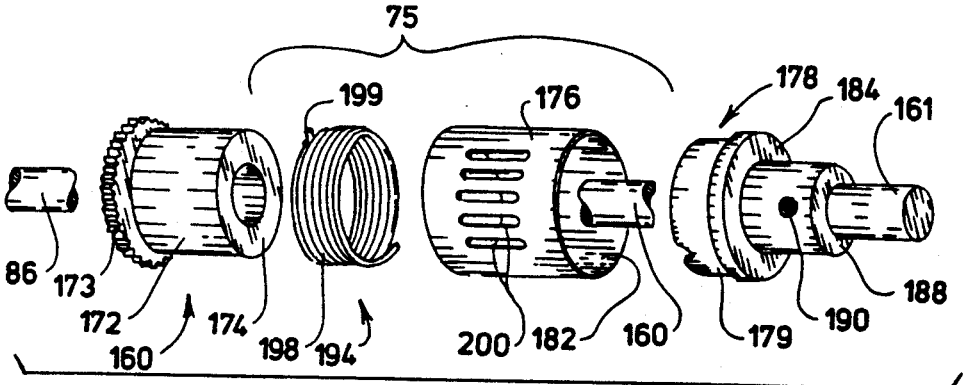
FIG. 12
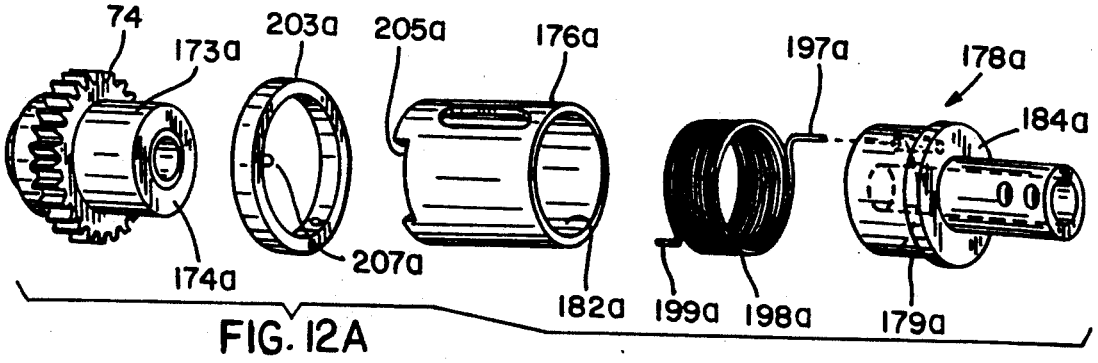
FIG. 12A

POWER REBAR TYPING TOOL

This is a continuation-in-part of copending application Ser. No. 07/739,612 filed on Aug. 2, 1991, now abandoned.

BACKGROUND OF THE INVENTION

The present invention relates generally to tools for tying wire. More particularly, this invention relates to portable, hand operated power tools for tying reinforcement rebar used in concrete construction.

As will be recognized by those skilled in the art, during concrete construction, arrays of reinforcement rods are erected within the forms so that when the concrete is poured, the resultant structure is strengthened by the "rebar." Typically intersecting sections of rebar are hand tied to each other with wire. Although it has been known in the prior art to provide various types of hand tools for tying rebar, numerous difficulties have existed in the past. One of the biggest problems is that prior art rebar tying tools tend to be cumbersome and heavy. To be effective on the job, an applicator tool must be relatively light weight and portable. However, the most important aspect is that of "reliability."

Prior art devices tend to be unreliable for several reasons. One reason is that most prior art devices are vulnerable to imperfections in the wire, caused by metal variances, kinks and the like. The relatively inexpensive and ductile wire used for tying rebar is difficult to reliably feed with mechanical devices. While the wire feed mechanism of such a device must be relatively powerful, the mechanism must not overpower the other working parts by unnecessarily forcing wire and jamming the mechanism. Through experimentation I have discovered that one secret of making a power rebar fastener system work properly is to provide a concentric interior construction in which the wire feeding and the jaw twisting section cooperate together about a central axis. Numerous other devices fail to appreciate this symmetry.

U.S. Pat. No. 4,362,192, issued Dec. 7, 1982 is typical of prior art power winding tools. This device is probably the closest known to me. It includes a rotating mandrel which functions in cooperation with a reciprocal jaw mechanism, but partially because the main jaws are both movable, tying problems are experienced. U.S. Pat. No. 3,391,715 issued Jul. 9, 1968, contemplates a jaw system which provides a looping mechanism, but the clamping solenoid system and the wire feed system do not feed wire through the construction herein disclosed. U.S. Pat. No. 3,169,559, Issued Feb. 16, 1965, discloses a system for tying rebar which is complicated by the fact that the applicator head includes rotating ears in the critical region for wire feeding. In other words the gear rotation and the wire feed occur transversely across an applicator region rather than at the output of a concentric system.

U.S. Pat. No. 4,834,148, Issued May 30, 1989, discloses a reinforcement binding machine having a pair of applicator jaws and a system for tying wire, but the jaws do not include a pair of fixed members with a captured looping jaw, and the wire feeding mechanism is not concentric with respect to the rotating barrel or mandrel. U.S. Pat. No. 4,953,598 discloses a hand-held power tool, but the applicator jaw is gear driven in a cumbersome fashion unlike our concentric layout. U.S. Pat. No. 4,498,506 discloses a wire system wherein the wire feeding mechanism is disposed in spaced relation with respect to the applicator head. The wire is fed through a cable so that the power wire feeding apparatus is unnecessarily separated from the critical applicator jaws. U.S. Pat. No. 4,685,493 issued Aug. 11, 1987, integrates the wire spool with the unit body, but does not include reciprocal jaws in the manner I have disclosed, nor does it include a concentric drive feed system which is responsible for reliability.

U.S. Pat. No. 4,177,842, issued Dec. 11, 1979, includes a feeding mechanism with a reciprocal jaw which attempts to provide looping, but the wire feed points are not controlled through the concentric arrangement I have proposed. The wire applicator head of Jones U.S. Pat. No. 3,026,915, Issued Mar. 27, 1962, discloses a rotating mandrel in which a pair of stops can catch wires fed on opposite sides of the mandrel, but lacks the concentric wire feeding system and jaw system herein disclosed.

SUMMARY OF THE INVENTION

Herein disclosed is a portable, hand operated power tool for automatically tying intersecting elongated rod-like elements such as rebar used in concrete construction. The tool speedily installs precision ties of uniform quality for binding crossing rebar sections. It employs conventional rebar tying wire held by the user in a spool conveniently secured to his belt by a conventional strap. Ease of use, reliability, speed, and portability are major characteristics of the tool.

An electric drive motor system selectively energizes an electrical-mechanical transmission disposed within a protective casing. The transmission selectively rotates a wire feed mechanism and a spindle barrel assembly which twists and then cuts the wire. The rotatable spindle barrel assembly is substantially coincident with the longitudinal axis of the tool. The wire feed gear system is substantially coaxially disposed about the spindle axis, and it is penetrated by a portion of the spindle drive shaft. A jaw assembly projects outwardly from the casing to encircle the crossed rebar sections, and wire is fed around rebar guide channels defined within the jaws. The jaw assembly is mounted to the casing by a rigid base coaxially surrounding the spindle barrel.

Separate clutch actuators control the wire feeding mechanism and the spindle barrel assembly. Both are gear driven within the transmission by the electric drive motor system. Each of the clutches are controlled by mechanical levers operated by electromagnets. When the tool is stopped or "off," critical mechanical control levers engage suitable slots within an out drive control sleeve of the drive actuators to prevent them from transmitting rotary motion. When the mechanical levers are withdrawn by the electromagnets, rotary motion will be transmitted downline for system activation.

The rigid jaw assembly comprises a pair of spaced apart and fixed jaw members integral with a tubular base coaxially mounted to the front of the tool. The center of the jaw base is penetrated by shaft portions of the spindle barrel which coaxially rotate therewithin. Each fixed jaw member includes arcuate guide grooves of substantially semi-circular shape to properly loop the wire. Preferably the lower fixed jaw member is comprised of separate spaced apart plates which sandwich a looping jaw. The pivoting looping jaw is displaceable between an open position, in which the jaw assembly may engage untied rebar, and a closed position where the jaws fully encircle intersecting rebar sections to be tied. The looping jaw comprises an internal groove adapted to receive and direct wire in a circular path in cooperation with the guide grooves in the fixed jaws. A control solenoid and suitable linkage can retract the looping jaw to close the jaw assembly about the rebar. The looping jaw comprises a boss adapted to be received within a follower notch defined in the bottom jaw member to positively lock the looping jaw during wire feeding.

After the jaws close, wire is drawn into and through the tool by rotation of the wire feed mechanism in response to its drive actuator. Wire is fed through to the jaws virtually at the center of the spindle barrel. The feed mechanism is driven by a worm gear meshed with a gear that rotates suitable friction drive wheels to force wire through the spindle, around the jaws, and back into the machine. Wire feeding is ended when returning wire activates a plunger which in turn signals an electric switch.

The spindle barrel rotates in response to its drive actuator which is activated after wire looping and feeding. The spindle drive shaft penetrates the wire feed mechanism at its center. The spindle barrel nose is configured with a pair of twist guides, wire guide canals cut in the face, and an adjustable tension cone to first cut and then form the tie. The spindle barrel assembly includes a pair of internally aligned, concentric shear disks through which wire passes for cutting.

Thus a fundamental object of the present invention is to provide a portable wire tying tool useful for concrete construction or the like.

A basic object is to provide a rebar tying tool which safely and automatically installs wire ties.

More particularly, an object of this invention is to provide a rebar tying tool which quickly and reliably ties tight wire loops about vertical rebar structures or similar structures.

Another object of the present invention is to provide a rebar tying tool of the character described having a reliable and simple wire feed system which can easily be used and transported, and which does not jam or cause tangles. It is a feature of the present invention that the wire is stored on an external spool which can conveniently be worn on the belt of the installer.

A related object is to provide an automatic wire feed system which prevents and eliminates wire jamming in the feed section. An important feature of this invention is that the positive wire feeding system is centered with respect to the wire twisting section.

Another related object is to provide a tool of the character described which will reliably install imperfect wire having kinks and irregular bends.

Yet another object of the present invention is to provide a rebar tying tool of the character described which facilitates one handed operation.

Another object is to provide a rebar tying tool of the character described which can operate from a battery pack, and thus employ direct current power without an external power cord.

A further object of the present invention is to provide a rebar tying tool with a reliable and efficient wire feeding mechanism which can handle either bare or coated wire, and which can thus be readily adapted to comply with the various local code requirements.

Another object is to provide a wire tying tool of the character described which forms no "loose ends" around the edges or ends of the tie.

Another fundamental object of the rebar typing tool is to provide an absolutely tight and reliable twist. It is a feature of the present invention that the adjustable tension nose cone preferably employed therein helps insure tight twists which stay on the rebar.

A still further object of the present invention is to provide a rebar tying tool of the character described which can easily receive the wire from the spool, and which will relieve the operator of the obligation to handle wire after initial feeding occurs.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 8 is an enlarged, fragmentary, longitudinal sectional view taken generally along line 8—8 of FIG. 6, with portions thereof broken away or omitted for clarity or brevity;

FIG. 10 is a fragmentary, vertical sectional view taken generally along line 10—10 of FIG. 7;

FIG. 11 is an enlarged, fragmentary isometric view showing the preferred transmission actuator and control mechanisms;

FIG. 12 is an enlarged, exploded isometric assembly view of a preferred positive drive mechanism;

FIG. 12A is an enlarged exploded isometric assembly view of a preferred spindle barrel actuator mechanism;

FIG. 13 is an enlarged, fragmentary sectional view of the preferred spindle barrel assembly;

FIG. 14 is an electrical schematic of the preferred control circuit;

DETAILED DESCRIPTION OF THE DRAWINGS

Figure 1:
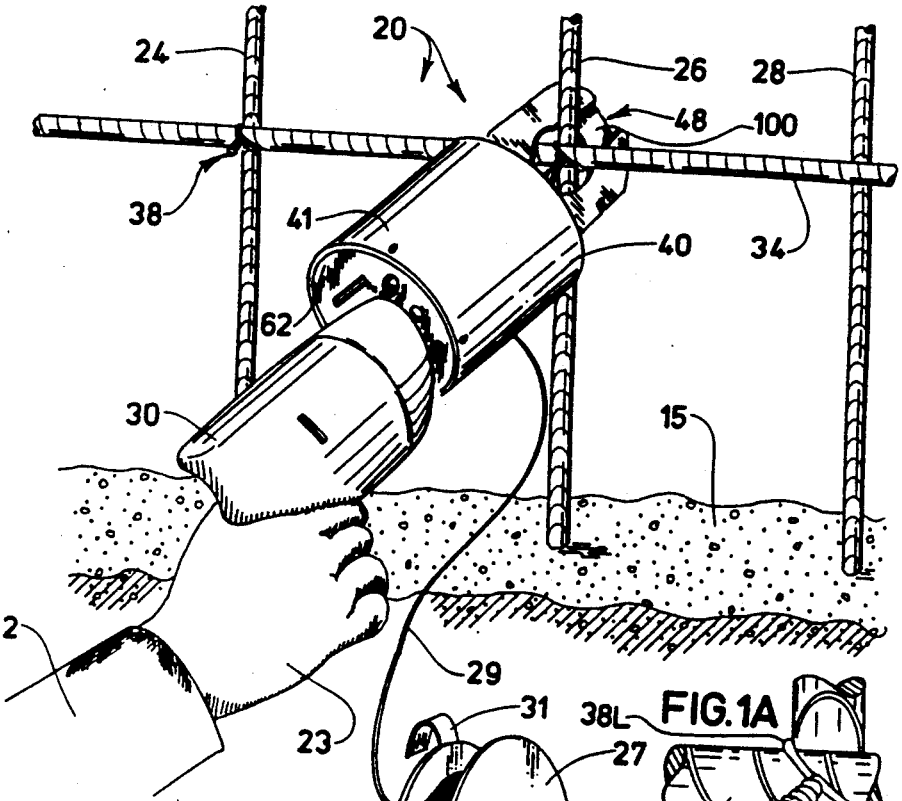
FIG. 1 is an enlarged, fragmentary perspective view illustrating the Power Rebar Tying Tool in use tying conventional concrete rebar, and showing an untied, a partially tied, and a tied rebar section.

With initial reference directed to FIGS. 1-4, 1A, 6 and 7 of the appended drawings, the Power Rebar Tying Tool has been generally designated by the reference numeral 20. Tool 20 is held in the hands 23 of an installer whose arm 22 is sufficient to control the apparatus. Conventional rebar is comprised of spaced apart, vertical reinforcement rods 24, 26, 28 which extend vertically upwardly from a previously laid concrete foundation 15. A horizontal rebar crosspiece 34 which extends across rods 24, 26, 28 must be tied with wire for bracing before concrete pouring. Tool 20 rapidly and automatically installs precision twists or ties 38 (FIG. 1A) to fasten the rebar portions together. Tool 20 utilizes wire 29 conveniently stored on a conventional spool 27 reliably secured to the belt of the user by a bracket 31.

Figure 2:
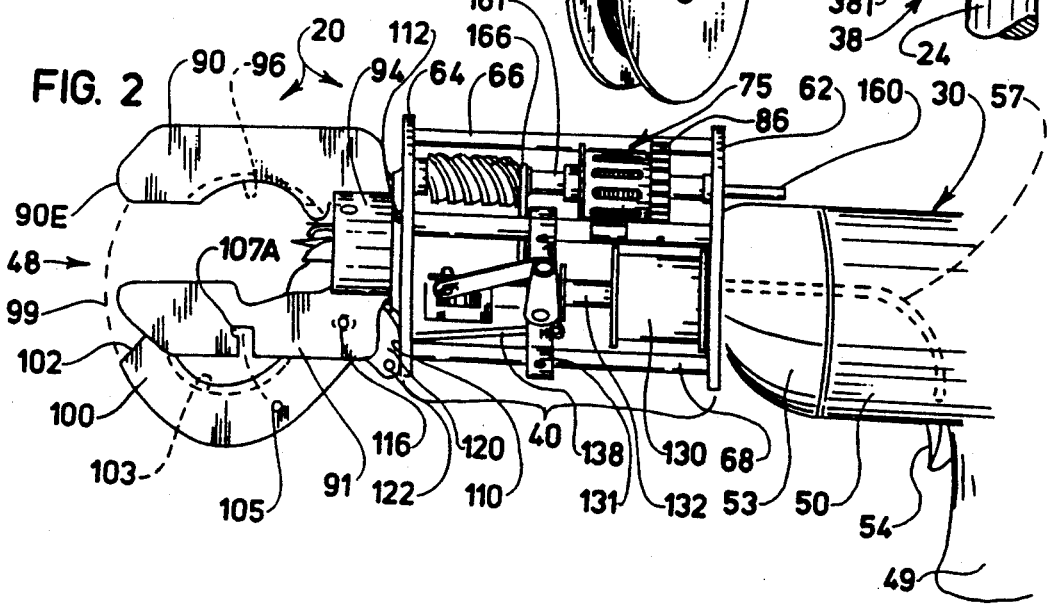
FIG. 2 is an enlarged, fragmentary left side elevational view of the tool, with portions thereof broken away for clarity or omitted for brevity, and with moved positions and concealed parts illustrated in dashed lines, with the looping jaw shown in an open position.
Figure 3:
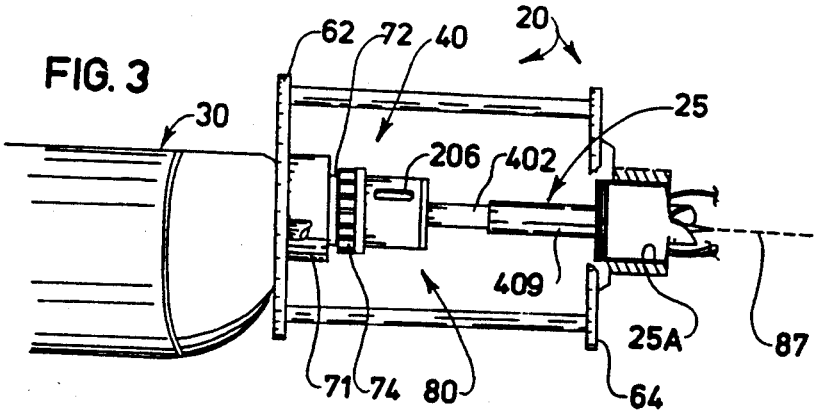
FIG. 3 is an enlarged fragmentary right side elevational view of the tool, with portions thereof broken away for clarity or omitted for brevity, primarily illustrating the spindle barrel drive assembly.

Tool 20 comprises a source of rotary mechanical power, generally designated by the reference numeral 30, which powers an electrical-mechanical transmission, generally designated by the reference numeral 40 (FIG. 2). The transmission parts are disposed within a tubular, protective casing 41. Transmission 40 operates the moving parts of the tool, generating reciprocal motion from its solenoids, electromagnets or limit switch to be described hereinafter, and selectively transmitting rotary motion to either a wire feed mechanism or a spindle barrel assembly as described later herein. The installing jaw assembly, generally designated by the reference numeral 48 (FIGS. 2, 4) projects outwardly from the forward end of the casing 41. Source 30 may comprise an electric drive motor of the type associated with conventional electric hand drills. Source 30 includes a handle 49 and casing 50 terminating in a head 53 secured to the rear of casing 41.

Figure 1A:
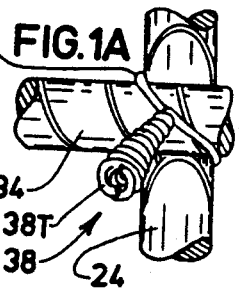
FIG. 1A is an enlarged, fragmentary perspective view showing the resultant tie after installation.

When trigger 54 is depressed by the user, a mechanical actuator link 57 extending into the transmission 40 will be displaced as hereinafter described to generate a mechanical control signal; an electrical control signal is also generated in response to trigger actuation. The electrical and mechanical control signals are delivered to the transmission 40. At this time the jaw assembly 48 will circumscribe the rebar intersection to be tied. Jaw closing is initiated by the electrical control signal. Afterwards, a feed cycle commences with wire 29 from spool 27 automatically being forced through the jaw assembly 48 into proper position around the rebar to be tied. Wire will reenter casing 41 and activate an internally disposed limit switch (to be described in detail hereinafter) which signals the transmission to end the wire feeding cycle. That signal also disengages a retractable looping jaw (to be described in detail hereinafter) which encircles the rebar to be tied, and triggers the spindle barrel assembly 25. The spindle barrel assembly includes critical shear disks which immediately cut the wire in response to transmission rotation. Subsequent rotation of the spindle barrel assembly 25 forms the neatly trimmed, cone-shaped ties 38 (FIG. 1A).

Casing 41 (FIG. 1) preferably comprises a pair of rigid, round, end plates 62, 64, which are rigidly maintained in spaced-apart, generally parallel relation by a plurality of elongated, parallel stanchions 66–69 which extend between them. As best viewed in FIG. 7, each of these stanchions 66–69 are threadably coupled to suitable orifices such as orifice 64B in end plate 64 by a conventional screw 66B (FIG. 8). Head 53 of drive source 30 is mechanically secured to end plate 62. Orifice 63 (FIG. 10) through end plate 62 accommodates the drive collar 71 (FIGS. 3, 7) driving the spindle barrel assembly 25. The spindle barrel assembly 25 is activated through its drive actuator 80 (FIGS. 3, 7, 11), which is geared to the wire feed drive actuator 75. Both drive actuators essentially function as clutches, transmitting rotary motion down line through the transmission when appropriately released by control levers. Clutching operations will be discussed in detail hereinafter.

Figures 7, 7A:
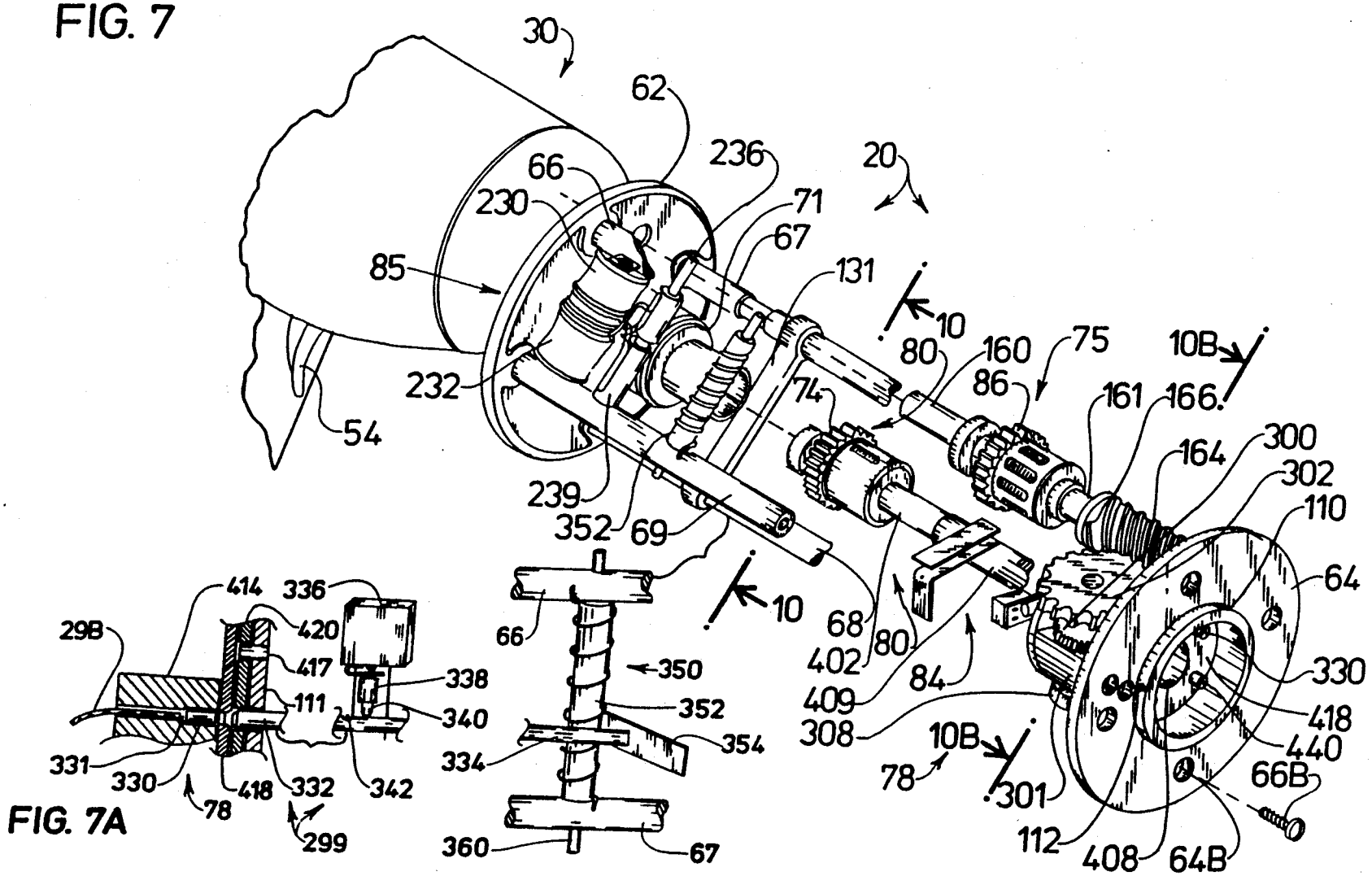
FIG. 7 is an enlarged, partially exploded, fragmentary, isometric view of the preferred wire feed mechanism, with portions thereof broken away or shown in section for clarity, and with portions of the spindle drive assembly omitted for brevity.
FIG. 7A is an exploded, fragmentary, diagrammatic view illustrating the preferred electromechanical wire feed switching mechanism, with portions thereof broken away or shown in section for clarity.

Gear 74 is meshed with and rotates gear 86 in actuator 75 (FIG. 11) which controls the wire feeding mechanism 78 at the remote end of the casing. The spindle drive actuator 80 is released (i.e. unclutched) to rotate the spindle barrel assembly 25 after a wire has been looped through the jaw assembly 48. Each of the actuators 75, 80 are controlled by a mechanical lever system generally designated by the reference numeral 84 (FIG. 11) which is operated by an electromagnetic cycle control assembly generally designated by the reference numeral 85 (FIGS. 7, 11). The lever system 84 normally engages the actuators 75 or 80 to prevent them from transmitting rotary motion to the shaft portions emanating from them. However, when the lever system is released in response to critical electrical and mechanical timing signals, rotary motion will be transmitted down line through the casing by the actuators.

As will be described hereinafter, electrical rotation imparted by driven gear 74 rotates meshed gear 86 associated with actuator 75 (FIG. 11). Prior to rotation being imparted through the transmission 40 through the actuator mechanisms, the jaw assembly 48 is activated to encircle the rebar to be tied. All the various transmission actuating mechanisms, actuator shafts and the like are confined within casing 41. Wire 29 (FIG. 1) is admitted into casing 41 through a feed tube 29B (FIG. 8), being drawn in by the feeding mechanism 78. Tube 29B interiorly extends within casing 41 to the feeding mechanism end plate 79.

With primary reference now jointly directed to FIGS. 2, 4, and 6–8, the preferred jaw assembly 48 comprises a pair of rigid, fixed jaw members 90, 91, which are integral with a generally tubular base 94 mounted to end plate 64. Jaw base 94 is coaxially fitted within mounting collar 110 integrally formed on the outside of plate 64 and firmly retained by screws 112. As will be hereinafter described in detail, the center of the jaw base 94 is penetrated by the spindle barrel 25A, which coaxially rotates therewithin. The spindle drive assembly 25 extends interiorly of the transmission casing 41 through the center of the wire feed mechanism 78 to be described hereinafter, generally along the longitudinal axis 87 (FIG. 3) of the tool 20.

Lower jaw member 91 is preferably comprised of two separate plates 91A, 91B, which are spaced apart to form a void region 98 into which the movable looping jaw 100 may be operationally nested. When activated the looping jaw 100 is sandwiched between the sides 91A and 91B of lower fixed jaw 91. The looping jaw 100 is displaceable between the open position of FIG. 2 and the closed position of FIGS. 8 and 16. When activated, the looping jaw 100 is forced through and into the space 98 (FIG. 6) between the lower fixed jaw plates 91A and 91B, moving through the arc 99 illustrated in FIG. 2. Its end 102 will be received within a suitable notch 101 (FIG. 8) in the end 90E of upper fixed jaw 90. A central region 152 (FIGS. 4,8) will be occupied by rebar and circumscribed by the jaws.

Looping jaw 100 comprises an internal groove 103 (FIG. 2) which receives and directs the wire 29 in a circular path. The upper jaw member 90 includes an elongated, arcuate groove 96, which, as viewed in FIG. 8, is substantially semi-circular to further direct wire in a semicircular path. Wire exiting looping jaw groove 103 enters groove 96. During tying, wire is drawn through the casing 41 and forced into the jaw assembly by feeder mechanism 78; wire driven into the looping jaw groove 103 follows groove 96 in the upper jaw member 90, before reentering casing 41. The wire is thus curved about the rebar before twisting, cutting and tying by the spindle barrel assembly 25.

Looping jaw 100 includes an offset tracking boss 105 (FIG. 2) projecting from both of its sides that is received within a follower notch 106A (FIG. 8) defined through the bottom of lower fixed jaw member 91. Notch 106A receives boss 105 when the looping jaw first begins to arc into the lower fixed jaw. Notch 106A has a forwardly projecting, generally horizontal segment 107A (FIGS. 2, 8) into which boss 105 will be forced by wire pressure. Boss 105 thus temporarily locks the looping jaw so that it cannot prematurely escape from its arced, deployed position. When looping jaw 100 moves through arc 99 (FIG. 2), boss 105 will initially be received within follower slot 106A; as soon as wire is forced through the apparatus the looping jaw will move forward (i.e. to the left as shown in FIG. 2) and boss 105 will be captured within follower 107A, so that the looping jaw positively cannot escape from the fixed jaws until allowed to do so, as will hereinafter be described.

Figure 4:
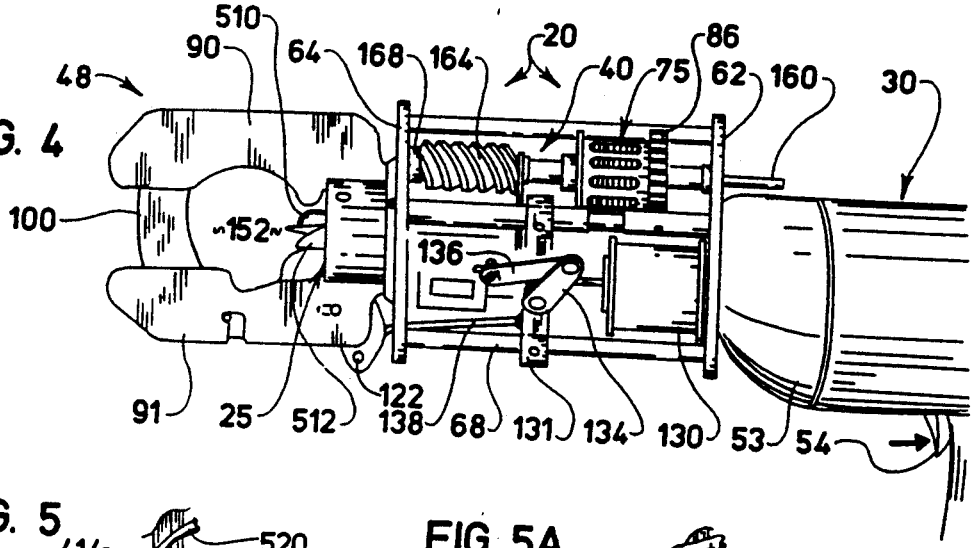
FIG. 4 is an enlarged fragmentary left side elevational view, with portions thereof broken away for clarity or omitted for brevity, illustrating the wire feed mechanism, and showing the looping jaw shown in a closed position.
Figure 6:
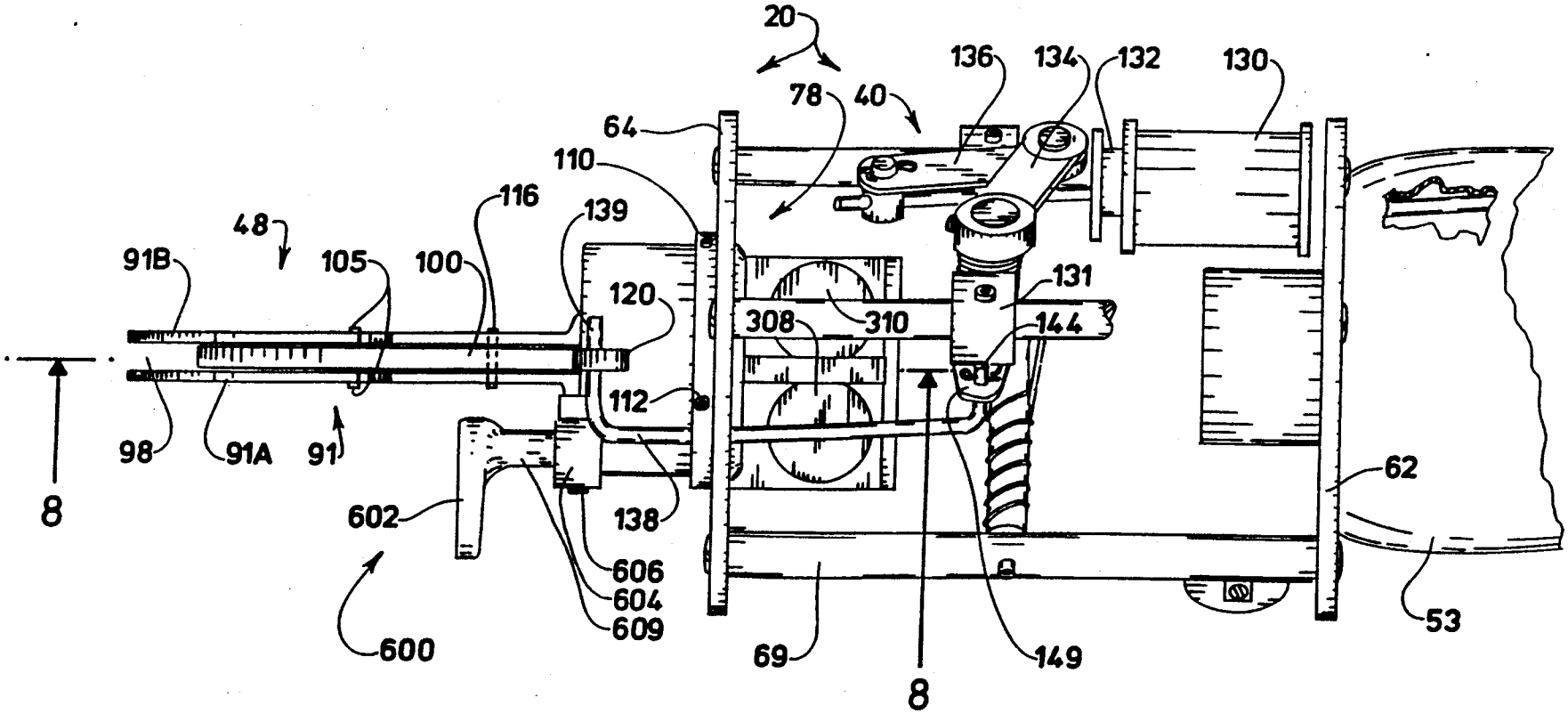
FIG. 6 is an enlarged fragmentary bottom elevational view of the tool, with portions broken away or shown in section for clarity and omitted for brevity.

Looping jaw 100 is pivotally secured within the lower fixed jaw by pin 116. The control end 120 (FIG. 2) of the looping jaw includes a connection orifice 122 for connection with suitable linkage 138 (FIG. 4) that can be retracted or extended. With primary reference now directed to FIGS. 2, 4, and 6, the looping jaw is first activated by a solenoid 130 fixedly mounted to the end plate 62 by a retainer 129 (FIG. 10). Solenoid 130 is normally spring biased to the position shown in FIG. 2 wherein the looping jaw 100 is "open." FIG. 4 shows relay 130 retracted and the looping jaw 100 closed. Brace 131 extending between stanchions 67 and 68 mounts followers 134 and 136 (FIG. 6). When electrically activated, plunger 132 is forcibly retracted to displace followers 136 and 134, rotating link 149 and thrusting looping jaw linkage 138 toward jaw 100. The end 139 (FIG. 6) of linkage 138 is received within orifice 122 of the looping jaw end 120 (FIG. 2). The opposite end 144 of linkage 138 is pivoted to link 149. Hence when solenoid 130 is activated, link 138 projects outwardly, closing the looping jaw 100, and the jaws thus circumscribe the rebar region to be tied.

After the jaws are closed in the manner described, wire 29 is drawn in through the casing 41 by wire feed mechanism 78. Actuator 75 is rotatably mounted by an elongated shaft 160 (FIGS. 2, 7, 9) which is journaled for rotation through end plates 62 and 64. Shaft 160 extends through the interior of the casing spaced apart from the longitudinal axis 87 (FIG. 3) and generally parallel therewith. The output portion 161 of shaft 160 (FIGS. 2, 11) terminates in a worm gear 164 journaled for rotation between a fixed plate 166 within casing 41 and a suitable bearing 168 (FIGS. 4, 9) projecting from the inner face 64A of end plate 64. Whenever shaft 160 (and portion 161) rotate, worm gear 164 will rotate. Worm gear 164 is meshed with the wire feeding mechanism 78 (FIG. 7).

With additional reference now to FIGS. 11 and 12, actuator 75 selectively rotates shaft 160 when the control lever system is released. The spindle barrel actuator 80 and the wire feeding actuator 75 function as clutches and are similarly configured. Actuator assembly 75 comprises a main drive unit 172 having a hollow body 173 coaxially secured to drive gear 86. Shaft 160 extends all the way through the center of the main drive body 173 and the control sleeve 176 through the outdrive 178, terminating in remote portion 161 splined to worm gear 166. The barrel portion 179 of outdrive 178, which may be slightly tapered, is press fitted within interior 182 of the sleeve 176. End 184 will be parallel with drive body end 174 and spaced apart therefrom. The harnessing collar 188 is frictionally engaged with shaft 160/161 with Allen nut 190. Sleeve 176 is coaxially disposed about drive body 173 with a coiled spring 194 frictionally disposed therebetween. Drive body 173 is preferably at least partially fitted into barrel 179 in a close fitting relationship so as to enhance clutch stabilization. Rotation of the spring is restrained by end 199 which is retained in notch 201 disposed through sleeve 176 adjacent gear 86. Limited slip is thus established between sleeve 176 and body 173 depending upon the direction of rotation; when any of the various control slots 200 that are radially spaced apart about the external periphery of sleeve 176 are engaged by the mechanical lever arm 211, the sleeve merely slips about the 1 coiled body 198 of spring 199 and is prevented from rotating. In other words, input rotation from gears 74 and 86 does not rotate shaft 160 unless mechanical lever member 211 is withdrawn from engagement within one of the slots 200. Similarly, the sleeve 202B (FIG. 11) forming part of the spindle actuator 80, cannot rotate sleeve 400 unless mechanical lever arm 210 is withdrawn from the single indexing slot 206. Slot 206 selectively receives mechanical lever arm 210, and since only one slot is employed proper indexing of the actuator 80 will always be achieved.

As previously stated, the spindle barrel actuator 80 is configured similarly to the wire feeding actuator 75. This substantial similarity will be appreciated through a comparison of FIG. 12 (wire feeding actuator assembly) to FIG. 12A (spindle barrel actuator assembly). As illustrated in FIG. 12A, the spindle barrel actuator 80 comprises a main drive unit having a hollow body 173*a* coaxially secured to drive gear 74. The barrel portion 179*a* of outdrive 178*a*, which may be slightly tapered, is press fitted within interior 182*a* of sleeve 176*a*. End 184*a* will be parallel with drive body end 174*a* and spaced apart therefrom. Sleeve 176*a* is coaxially disposed about drive body 173*a* with a coiled spring 198*a* frictionally disposed therebetween. Drive body 173*a* is preferably at least partially fitted into barrel 179*a* in a close fitting relationship so as to enhance clutch stabilization. Rotation of spring 198*a* is restrained by its end 197*a* which is secured within tapered barrel 179*a*.

As illustrated, spring 198*a* is provided with a tang 199*a* disposed at its other end. Following assembly, spring tang 199*a* will ride within a groove formed at the interface of sleeve 176*a* and adjustable set collar 203*a*. This groove is formed by means of a notch 205*a* extending partially about the circumference of sleeve 176*a*. As will be appreciated, during rotation of the outdrive 178*a*, the spring 198*a* will also tend to rotate. The extent of this rotation will, however, be limited by any obstruction encountered by tang 199*a*. As illustrated, set collar 203*a* is provided with an internally disposed detent 207*a* which will contact tang 199*a* during rotation, therby limiting such rotation. Limited slip is thus established between sleeve 176*a* and outdrive 178*a*, with the extent of such slip being determined by the placement of the set collar detent 207*a* relative to notch 205*a*. In the preferred embodiment, set collar 203*a* will be secured in place by means of a set screw 209 (FIG. 11) thereby permitting the collar 203*a* to be set in the position necessary to achieve proper spring rotation.

At the start of a tying cycle lever arm 210 is withdrawn from index slot 206 allowing the actuator 80 to rotate the spindle barrel assembly by transmitting rotary motion from gear 74. When tying is finished, lever arm 210 will again contact slot 206 stopping spindle barrel rotation (whether or not gear 74 is turning) at a point where the wire feed ports to be later described are stopped in correct alignment for a subsequent wire feed cycle.

With primary reference now directed to FIGS. 7 and 11, the electromechanical cycle control unit 85 engages or disengages the clutch actuators 75, 80 through the lever system 84 comprising mechanical lever arms 210, 211. The electromechanical cycle oontrol unit 85 (FIG. 11) comprises a pair of separate electromagnets 230, 232 axially mounted by an elongated shaft 234 extending between casing stanchions 66 and 69 (FIG. 7). A parallel control shaft 236 is spaced apart from shaft 234 and also extends between stanchions 66 and 69. Actuator sleeves 238, 239 are slidably, coaxially mounted to shaft 236, and biased apart with a captivated spring 242. Sleeve 238 controls mechanical lever arm 211, and lower sleeve 239 controls mechanical lever arm 210. When electromagnet 232 is activated, its control link 247 will be drawn downwardly, drawing sleeve 238 with it, thus deflecting lever arm 211 out of engagement with one of the slots 200 in sleeve 176. Similarly, when electromagnet 230 is activated, sleeve 239 will be drawn upwardly, disengaging lever arm 210 from index slot 206, thereby releasing actuator 80. In the preferred embodiment, control link 247 will be non-magnetic, thereby enhancing free movement along control shaft 236. Likewise, elongated shaft 234 should also be non-magnetic. Actuator body 202B has only one index slot 206, so that the spindle barrel assembly 25 will always stop in an appropriately aligned position. In other words, slot 206 is employed to index the device, so that each time a wire is tied, the spindle barrel assembly 25 will stop in the correct position after release of electromagnet 230 as lever arm 210 finds and engages index slot 206. Thus electrical control of the pertinent electromagnets 230 or 232 establishes which of the actuator mechanisms are free to transmit rotary motion towards end plate 64 and the applicator jaws.

Figures 9, 10A, 10B, 15, 16:
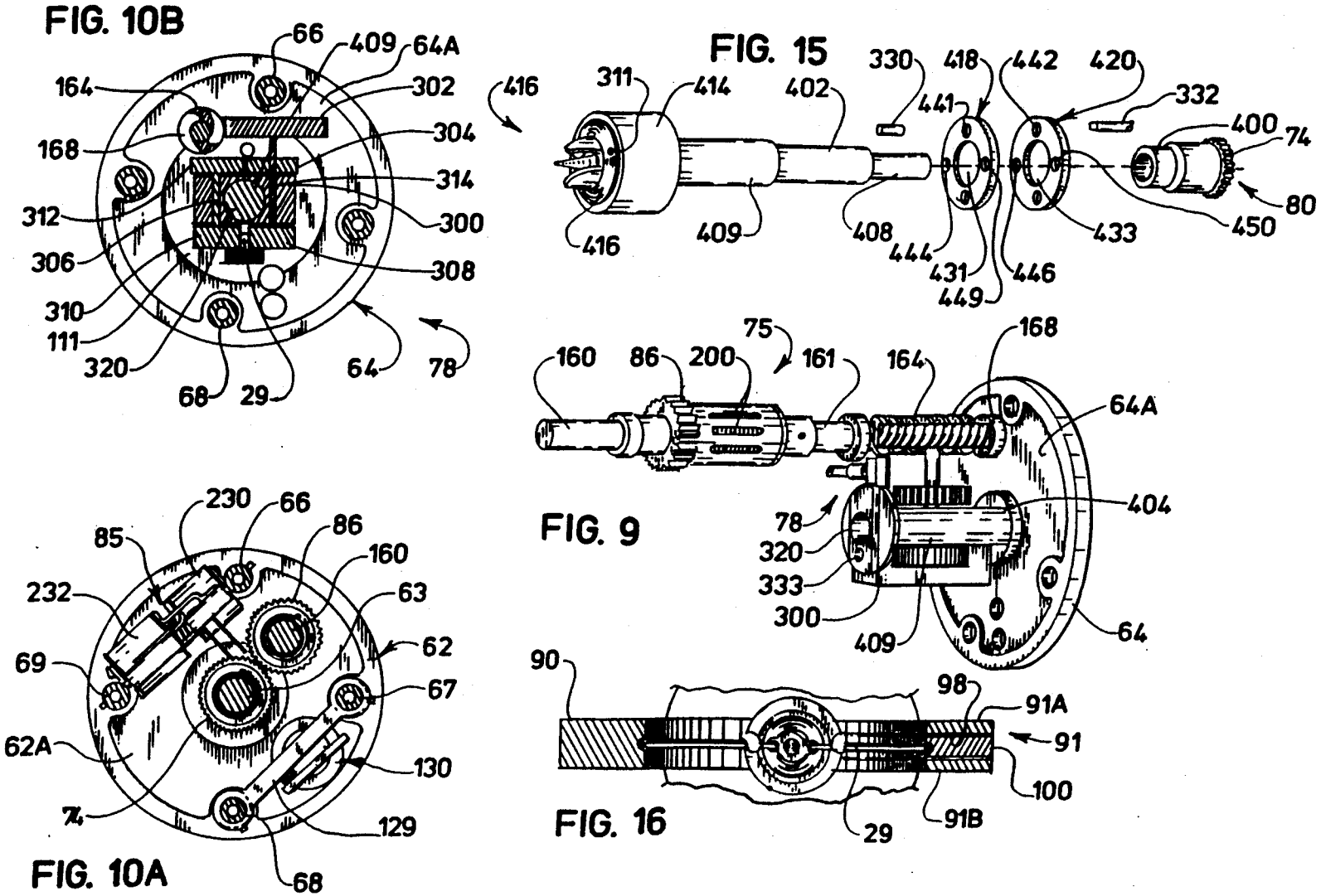
FIG. 9 is a partially fragmentary, interior perspective view primarily illustrating the wire feed system, with portions thereof broken away or omitted for clarity.
FIG. 10B is a fragmentary, vertical sectional view taken generally along line 10B—10B of FIG. 7.
FIG. 15 is an exploded, isometric assembly view further illustrating the spindle barrel assembly.
FIG. 16 is an enlarged, fragmentary, sectional view, of the jaws, taken generally along line 16—16 of FIG. 8.

With primary reference now directed to FIGS. 7-9 and 10B, the wire feeding mechanism 78 is secured to the back of end plate 64 between tabs 301 (FIG. 7) that secure frame block 300. Block 300 is of generally rectangular cross section. Worm gear 164, which cranks feeding mechanism 78, is meshed with drive gear 302 (FIG. 10B) which drives a lower gear 304, a shaft 314, and a wire feed wheel 308. Feed wheel 308 is rotatably disposed beneath block 300, immediately adjacent companion feed wheel 310. Gear 304 is meshed with companion drive gear 312 that drives shaft 306 and the wire drive wheel 310. Wheels 310 and 308 rotate in unison to frictionally draw wire through them, as best seen in FIG. 10B.

Figure 5:
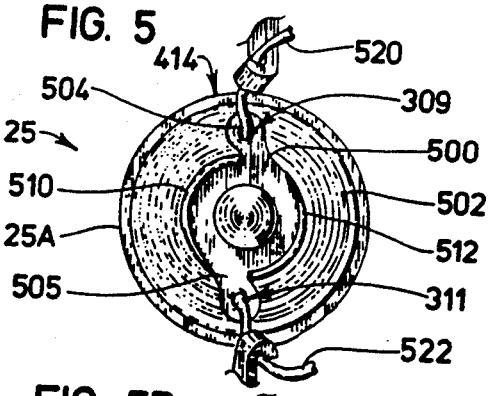
FIG. 5 is an enlarged, fragmentary front elevational view taken from a position generally to the right of FIG. 3, with portions thereof omitted for brevity, showing the spindle drive immediately before commencement of a wire twisting operation.
Figure 5A:
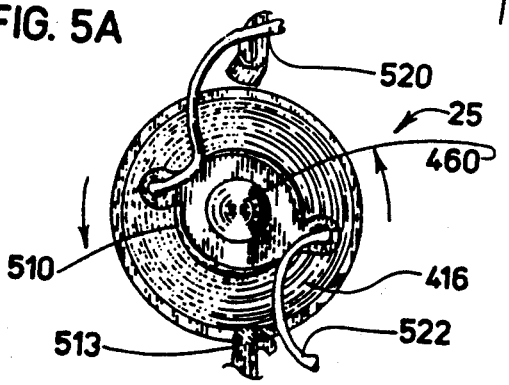
FIG. 5A is an enlarged, fragmentary front elevational view similar to FIG. 5, but showing the spindle drive in a rotated position after tying commences.
Figure 5B:
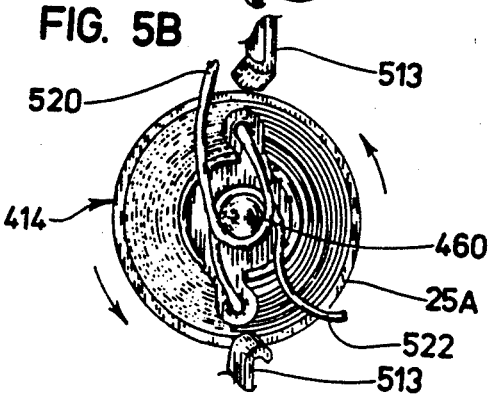
FIG. 5B is an enlarged, fragmentary front elevational view similar to FIGS. 5 and 5A, but showing the spindle drive in a further rotated position with a partially completed wire twist.
Figure 5C:
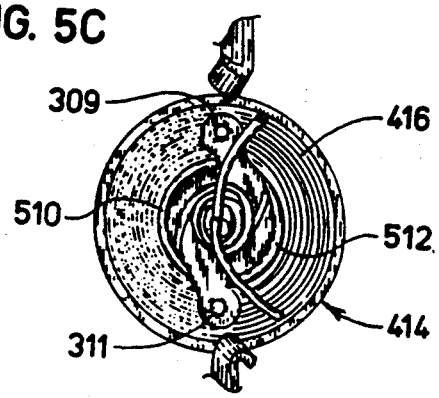
FIG. 5C is an enlarged, fragmentary front elevational view similar to FIGS. 5, 5A and 5B, but showing the spindle drive in a much further rotated position, with the tie completed.

Importantly, the spindle barrel drive assembly 25 protrudes immediately through the middle of the wire feed mechanism though orifice 320. Wire is fed through to the apparatus at the outer edge of the spindle barrel 25A, as best illustrated in FIGS. 5-5C to be described in detail hereinafter. The spindle barrel 25A includes shaft portions centered through the feed assembly, and this generally co-axial relationship is partially responsible for the efficient and dependable wire feeding accomplished by this tool. Thus the wire drive mechanism is disposed about the spindle drive mechanism 25.

Wire 29 is fed between wire feed wheels 308 and 310 into the pindle barrel through passageway 224 (FIG. 13) and out through an exit port 309 (FIGS. 5C, 13), through the jaws, and back into the casing 41 through an entrance port 311 (FIGS. 5, 15) defined in the spindle barrel face. Wire is fed into and through the spindle barrel assembly 25, through the bottom fixed jaw 91, up around the displaced looping jaw 100, back around the upper fixed jaw 90, and then back through the spindle barrel assembly 25 through port 311. It returns through an appropriate pathway in the wire feed mechanism block 300 into the interior of the apparatus. When this occurs, the wire end activates an electro-mechanical switching system to thereafter activate the spindle drive mechanism; subsequent twisttng will cut and tie the wire.

The preferred electro-mechanical switching system has been generally designated by the reference numeral 299 (FIG. 7A). After wire is looped through thr jaws with the drive mechanism 78, substantially completing the path illustrated best in FIG. 8, the return end 29B of the wire (FIG. 7A) penetrates the feeder mechanism block 300 by enteringfeed mechanism passageway 333 (FIG. 9). It then passes through the shear disks (to be described later), enters the spindle barrel nose cone passageway 224 (FIG. 13), and exits via hole 222, thereafter entering the jaws previously discussed. Looped wire returns from the jaws, and reenters the spindle barrel via orifice 311 (FIGS. 5C, 15), entering spindle barrel passageway 331 (FIG. 7A) and contacts a plunger 330 inside the spindle barrel which is adjacent to shear disks 418 and 420. In the preferred embodiment, plunger 330 will be partially hollow (FIG. 13) so as to allow partial penetration by the wire 29. Once plunger 330 has been penetrated by wire 29 plunger 330 hits reciprocally mounted plunger 332 which is normally bised inwardly (i.e. towards the right of FIG. 7A) and which penetrates aligned orifices in the periphery of the shear disks. Plunger 332 can move both left and right, as viewed in FIG. 7A. Thus, plunger 330 can displace plunger 332 from shear disk 418. It is preferable that plunger 332 have a bevelled end corresponding to a similar bevel in the surface of the orifice in shear disk 418. As will be appreciated, such a bevelled relationship facilitates the removal of plunger 332 from rotatable shear disk 418 even if plunger 330 is not fully activated. Plunger remote end 334 is contacted in response to actuator link 57 previously described. Importantly wire being fed twice passes through suitable orifices (i.e. FIG. 15) defined in a pairof aligned shear disks 418 and 420 associated with the spindle barrel assembly which are to be described later. The shear disks are responsible for subsequent wire cutting when the spindle barrel assembly is activated after proper wire feeding.

The single pole, double throw (SPDT) electrical switch 336 comprises a spring biased follower 338 projecting downwardly into a plunger 340. Plunger 340 rides plunger 332, activating switch 336 when engaging groove 342 (FIG. 7A). Linkage generally designated by the reference numeral 350 comprises a rotatable sleeve 352 mounted between casing stanchions 66, 67 by shaft 360 and biased by spring 354 against predetermined pressure from the actuator link 57 previously described. Link 57 is moved backwards (i.e. to the right as viewed in FIG. 7A) when the drive motor trigger is first pulled. It is attached to the shaft 352 by radial arm 354, and when the shaft 352 is rotated, arm 354 moves right to allow actuating plunger 332 to move out of the feed mechanism block 300 in response to wire contact. When plunger 332 moves right, switch plunger 340 escapes groove 342 and moves up to turn switch 336 on; switch 336 then releases the lever 210 to energize actuator 80 previously described. The wire feed mechanism is then activated, and when wire end 29B returns through the apparatus passing through block 300, thereafter contacting and displacing plunger 332, switch plunger 340 again signals switch 336 to activate the electromagnet associated with the spindle drive unit. Thus control signals are mechanically and electrically generated. A subsequent mechanical signal from returning wire end 29B reactivates switch 336, and after a twisting operation as will hereinafter be described, the machine is reset when switch plunger 340 returns to its quiescent position within plunger groove 342 (FIG. 7A).

With reference now primarily directed to FIGS. 3, 7, 9, 13 and 15, the spindle barrel assembly 25 is driven in response to rotation from collar 71 that is splined to gear 74 in actuator 80. Output sleeve 400 is rotated by actuator 80 only when the electro-mechanical cycle control unit 85 is properly signaled with the limit switch system 299 (FIG. 7A) previously discussed; when lever 210 (FIG. 11) withdraws from index slot 206, sleeve 400 rotates. Sleeve 400 receives a shaft 408 which is frictionally held by allen screws 401 (FIG. 11). Shaft 408 is axially connected to segments 402 and 409. Segment 409 penetrates orifice 320 (FIGS. 9, 10B) in the block 300 of wire feed mechanism 78. Segment 409 is journaled for rotation through collar 404 (FIGS. 8,9) in the back 62A of end plate 62 and coaxially penetrates aligned shear disks 418 and 420 (FIGS. 13, 15), integrally terminating in spindle nose cone 414. Nosecone 414 (FIG. 13) is of generally cylindrical proportions, terminating in an outer, substantially circular face 416 provided with recessed regions (FIGS. 5-5C) to be discussed hereinafter. This latter configuration aids in the twisting and cutting of wire. Wire is fed immediately adjacent to the spindle barrel through a pair of shear disks 418, 420 received within collar 110 in the external side of end plate 64 previously described (FIG. 7).

Each shear disk preferably comprises four radially spaced apart, normally aligned orifices (FIG. 15). Exit orifices 444 and 446 are initially aligned to pass wire out through the jaws during feeding; wire returns into the wire feeder (to activate the system of FIG. 7A) through entrance orifices 449, 450. Each shear disk has a clearance hole 431 or 433 in its center penetrated by shaft segment 402. Plunger 332 (FIGS. 7A, 15) is received though the shear disk orifices 449, 450. A pin 440 (FIG. 7) projecting from the spindle barrel 414 is received within shear disk orifice 441 (FIG. 15) to lock disk 418 to the spindle barrel for rotation and to normally insure alignment. Suitable pins 417 (FIG. 7A) emanating from the base 111 (FIGS. 7A, 8, 10B) of collar 110 penetrate orifices 442 (FIG. 15) in shear disk 420 to lock it in position.

An adjustable tension cone 460 projects outwardly from the center of the spindle barrel 414. The cone shank 461 is received within passageway 464. A smaller diameter shank portion 468 exists to receive lock 470 driven by set screw 471 received within threaded passageway 473 (FIGS. 13), which intersects passageway 464. Lock 470 is forced into compressive contact with shank 461 to lock cone 460 in an appropriate position.

As viewed in FIGS. 5-5C, an annular slot 500 is recessed into the face 416 of the spindle barrel. Slot 500 includes recessed portions 504, 505 respectively surrounding the exit port 309 and entrance port 311. Wire portion 520 exits the spindle barrel; wire portion 522 returns into it. Before twisting the wire portions are nestled within cradles 513 associated with the fixed jaws previously discussed. When twisting progresses to the position of FIG. 5A, wire is dislodged from the cradles 513. FIG. 5B shows wire being wrapped around cone 460. Recess 500 coaxially surrounds twist guides 510, 512, which project outwardly from opposite sides of the adjustable tension cone 460 (FIG. 13). When twisting is initiated by rotating the spindle barrel assembly 25, the wire is eventually cut by spindle movement, being sheared by the disks 418, 420. Loose wire which escapes from the spindle barrel is wrapped around cone 460 by the twist guides. Wire ends 520 and 522 exit to the surface of the spindle barrel and contact the twist guides 510, 512 (FIG. 5C), and each wire end will be rotated and twisted into the tie 38 (FIG. 1A) being made. As seen in FIG. 1A, no loose ends result on the tie.

The depth adjustment gauge 600 (FIG. 6) spaces the front of the apparatus from the rebar. Gauge 600 comprises a forwardly projecting block 602 secured to boss 604 by a set screw 606. Shaft 609 can be located as desired for alignment. It is adjusted for different sizes of rebar to properly center them within jaw orifice 152 (FIG. 8).

FIG. 14 reveals the preferred electrical schematic 700. Circuit 700 receives 120 volt A.C. from conventional plug 706, so that power is applied across lines 703 and 705 when double-pole, single throw (DPST) switch 754 is closed by trigger 54. Switch 336, previously discussed, will energize either electromagnet field 702 associated with the spindle drive electromagnet, or the combination of electromagnet field 701 and plunger solenoid field 704. As mechanical movement illustrated diagrammatically in FIG. 7A occurs, the various fields will be energized in response to movement of plunger 340 associated with switch 336.

OPERATION

A reel of tie wire is attached to the operator's belt. The loose end of the tie wire is then inserted into the Rebar Fastener through the entry port located on the main control body, and inserted until it stops. The wire is at the automatic feed control section. The jaw section of the rebar fastener is manually placed about the rebar intersection. With the trigger engaged an electrical signal is sent to the electrical solenoid 130 (FIG. 4) that controls the retractable looping jaw 100. As the solenoid is engaged it will case the mechanical movement closing the retractable jaw.

Worm gear 164 rotates the wire feeding mechanism previously described. With the wire feeder unit engaged, the tie wire will begin its travel. The wire passes through the shear discs, the spindle barrel, and the wire guide channels of the jaws. The terminal end of the wire will completely encircle the rebar intersection. The end of the wire will now leave the looping jaw and reenter the spindle barrel through the reentry port, activating the limit switch to cease wire feeding and initiate rotation which in turn disengages looping jaw.

As the spindle barrel begins its rotation, the tie wire is sheared at stationary shear disc 418 by rotatable shear disk 420. With the rotating action of the spindle barrel, the tie wire loop, formed by the looping jaws, will become stationary as it meets the rebar. Now that the loop is stationary, the ends of the tie wire will begin to extract from the spindle barrel.

As the spindle barrel rotates the nose cone of the spindle barrel will begin to form the twist tie. As the wire comes from the spindle barrel the twist guides located on the nose cone of the spindle barrel will form the wire around the adjustable tension control cone. The tension setting of the adjustable tension control cone will, along with the adjustable depth gauge, located on the stationary section of the looping jaws will determine the tightness of the twist tie.

With the twist tie completed, subsequent release of the trigger releases electromagnetic cycle control unit 85, and mechanical lever 210 (FIG. 11) drops to find index slot 206, stopping spindle rotation.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable, hand operated power tool for automatically tying intersecting rod-like members, rebar or the like with wire, said tool comprising:

motive means for providing rotary motion to said tool;

jaw means protruding from said tool for first surrounding a portion of the rebar or the like to be tied and then encircling same with wire, said jaw means comprising a retractable looping jaw adapted to be displaced between open and closed positions;

wire feed means for forcing wire though said jaw means around the rebar or the like to be tied;

spindle barrel means for twisting and cutting the wire forced through said jaw means, said spindle barrel means comprising a rotatable head disposed adjacent said jaw means, a wire exit and wire inlet port communicating with said jaw means, and a shaft portion extending generally coaxially through said wire feed means and selectively driven by said motive means.

2. The tool as defined in claim 1 wherein said spindle barrel means is substantially coincident with the longitudinal axis of the tool.

3. The tool as defined in claim 2 further comprising guide channel means defined within said jaw means in communication with said wire exit and wire inlet ports.

4. The tool as defined in claim 1 further comprising transmission means for selectively activating said jaw means, said wire feed means, and said spindle barrel means said transmission means comprising:

gear means rotating in response to said motive means, means for selectively activating said looping jaw at the start of a tying cycle;

first clutch actuator means meshed to said gear means for activating said wire feeding mechanism; and, second clutch actuator means driven by said gear means for selectively activating said spindle barrel assembly.

5. The tool as defined in claim 4 wherein said means for selectively activating said looping jaw at the start of a tying cycle comprises solenoid means activated by trigger means associated with said motive means.

6. The tool as defined in claim 4 further comprising:

clutch lever means for normally activating said first and second clutch means for preventing activation of said wire feed means and said spindle means; and, second solenoid means for controlling said clutch lever means to sequentially operate said wire feed means and then said spindle barrel means.

7. The tool as defined in claim 6 wherein said first clutch means comprises a plurality of radially spaced apart clutch control slots adapted to be engaged and unengaged by said clutch lever means, said second clutch means comprises an index slot adapted to be normally engaged by said clutch lever means but unengaged at the start of a twisting cycle.

8. The tool as defined in claim 1 wherein said jaw means comprises a pair of rigid, spaced apart fixed jaw members integral with and projecting outwardly from a rigid, generally tubular base mounted to the front of the tool.

9. The tool as defined in claim 8 wherein one of said plates which pivotally mount and sandwich said looping jaw.

10. The tool as defined in claim 9 wherein each fixed jaw members and said looping jaw comprises internal, arcuate guide grooves of substantially semi-circular shape to properly loop the wire.

11. The tool as defined in claim 10 wherein the center of the jaw base is coaxially penetrated by said spindle barrel means which, when activated, rotates therewithin.

12. The tool as defined in claim 9 wherein said jaw means comprises a follower notch, and said looping jaw comprises an offset boss adapted to be received within said follower notch positively preventing escape of said looping jaw until a wire tying cycle is complete.

13. The tool as defined in claim 1 wherein said wire feed means comprises a body penetrated by said spindle barrel means, gear means driven by clutch means to activate said wire feed means, and wire feed wheel means driven by said last mentioned gear means to force wire through said jaw means.

14. The tool as defined in claim 13 including electromechanical circuit means responsive to completion of wire feeding to disengage said clutch means to end a feeding cycle.

15. The tool as defined in claim 1 wherein said spindle barrel means comprises a drive shaft extending through said wire feed means.

16. The tool as defined in claim 15 wherein said spindle barrel means comprises a nose cone configured with a pair of twist guides to first form and then cut the wire tie.

17. The tool as defined in claim 16 wherein said spindle barrel assembly comprises a pair of cooperating, and aligned shear disks through which wire passes for cutting.

18. A portable, hand operated power tool for automatically tying rebar, said tool comprising:

a longitudinal axis;

means for inputting rotary motion to said tool;

jaw means protruding from said tool for first surrounding a portion of the rebar or the like to be tied and then encircling same with wire, said jaw means comprising a pair of fixed jaws and a retractable looping jaw pivoted to one of said fixed jaws adapted to be displaced between open and closed positions for encircling rebar to be tied, the jaws having internal guide channel means for directing wire;

solenoid means for selectively activating said looping jaw at the start of a typing cycle;

wire feed means for forcing wire through said jaw means around the rebar or the like to be tied;

rotatable spindle barrel means for twisting and cutting the wire forced through said jaw means, said spindle barrel means comprising a rotatable head disposed centrally of jaw means, a wire exit and wire inlet port communicating with said jaw means, and a shaft portion extending generally coaxially through said wire feed means and selectively driven by said motive means, said shaft substantially coincident with said longitudinal axis;

first clutch actuator means for activating said wire feeding means; and, second clutch actuator means for selectively activating said spindle barrel means.

19. The tool as defined in claim 18 wherein said spindle barrel assembly comprises a pair of cooperating aligned shear disks through which wire passes for cutting.

20. A portable, hand-operated, power tool for automatically typing rebar, said tool comprising:

an elongated casing:

a source of rotary motion coupled to said casing;

jaw means protruding from said casing for first surrounding a portion of the rebar or the like to be tied and then encircling same with wire, said jaw means comprising a pair of fixed jaws and a retractable looping jaw pivoted to one of said fixed jaws adapted to be displaced between open and closed positions for encircling rebar to be tied, the jaws having internal guide channel means for directing wire;

solenoid means for selectively activating said looping jaw at the start of a tying cycle;

wire feed means for forcing wire though said jaw means around the rebar or the like to be tied;

rotatable spindle barrel means for twisting and cutting the wire forced through said jaw means, said spindle barrel means comprising a rotatable head disposed centrally of jaw means, a wire exit and wire inlet port communication with said jaw means, and a shaft portion extending generally coaxially through said wire feed means and selectively driven by said motive means, said shaft substantially coincident with said longitudinal axis;

transmission means disposed within said casing for operating said tool in response to said source of rotary motion, said transmission means comprising first clutch actuator means for activating said wire feeding means and second clutch actuator means for selectively activating said spindle barrel means, said first clutch actuator menas geared to said second clutch actuator means; and, shear disk means for cutting wire.

* * * * *

UNITED STATES PATENT AND TRADEMARK OFFICE

CERTIFICATE OF CORRECTION

PATENT NO. : 5,217,049

DATED : June 8, 1993

INVENTOR(S) : EUGENE FORSYTH

It is certified that error appears in the above-identified patent and that said Letters Patent is hereby corrected as shown below:

ON THE TITLE PAGE

[54] In the title delete "TYPING" and substitute therefor -- TYING --.

Column 1, line 2, delete "typing" and insert--tying--.

Column 4, line 1, delete "typing" and substitute therefor -- tying --.

Column 5, line 10, delete "Fig. 10" and substitute therefor -- FIG. 10A --.

Column 5, line 11, delete "10-10" and substitute therefor -- 10A-10A --.

Column 6, line 30, delete "(FIG 10)" and substitute therefor -- (FIG 10A) --.

UNITED STATES PATENT AND TRADEMARK OFFICE

CERTIFICATE OF CORRECTION

PATENT NO. : 5,217,049

DATED : June 8, 1993

INVENTOR(S) : EUGENE FORSYTH

It is certified that error appears in the above-identified patent and that said Letters Patent is hereby corrected as shown below:

Column 6, line 31, after (FIGS. 3,7) insert -- which enters the interior of the casing and rotates chuck 72 and splined drive gear 74. Gear 74 inputs power to the transmission 40. It is rotated by the drive collar 71 (FIGS. 3,7) --.

Column 8, line 1, delete (FIG. 10) and substitute therefor -- (Fig. 10A) --.

Column 8, line 58, delete "1".

Column 9, line 54, delete "oontrol" and substitute therefor -- control --.

Column 10, line 33, delete "though" and substitute therefor -- through --.

Column 10, line 43, delete "pindle" and substitute therefor -- spindle --.

Column 10, line 56, delete "twisttng" and substitute therefor -- twisting --.

UNITED STATES PATENT AND TRADEMARK OFFICE

CERTIFICATE OF CORRECTION

PATENT NO. : 5,217,049

DATED : June 8, 1993

INVENTOR(S) : EUGENE FORSYTH

It is certified that error appears in the above-identified patent and that said Letters Patent is hereby corrected as shown below:

Column 10, line 60. delete "thr" and substitute therefor -- the --.

Column 10, line 64, delete "enteringfeed" and substitute therefor -- entering feed--.

Column 11, line 23, delete "pairof" and substitute therefor -- pair of --.

IN THE CLAIMS:

Column 14, line 14, delete "though" and substitute therefor -- through--.

Column 14, line 66, after "one of said" insert -- fixed jaw members comprises a pair of separate spaced apart --.

Column 15, line 51, delete "typing" and substitute therefor -- tying--.

UNITED STATES PATENT AND TRADEMARK OFFICE

CERTIFICATE OF CORRECTION

PATENT NO. : 5,217,049

DATED : June 8, 1993

INVENTOR(S) : EUGENE FORSYTH

It is certified that error appears in the above-identified patent and that said Letters Patent is hereby corrected as shown below:

Column 16, line 19, delete "typing" and substitute therefor -- tying--.

Column 16, line 33, delete "though" and substitute therefor -- through --.

Column 16, line 50, delete "menas" and substitute therefor -- means --.

Signed and Sealed this

Twenty-sixth Day of April, 1994

Bruce Lehman

*Attest:*

BRUCE LEHMAN

*Attesting Officer*

*Commissioner of Patents and Trademarks*